US005325636A

United States Patent [19]

Attanasio et al.

[11] Patent Number: 5,325,636

[45] Date of Patent: Jul. 5, 1994

[54] POLISHING MACHINE WITH PNEUMATIC TOOL PRESSURE ADJUSTMENT

[75] Inventors: Claude Attanasio, Chalon Sur Saone; Jean-Claude Seigue, Virey Le Grand, both of France

[73] Assignee: SEVA, Chalon Sur Saone, France

[21] Appl. No.: 889,621

[22] Filed: May 28, 1992

[30] Foreign Application Priority Data

Jun. 4, 1991 [FR] France ..... 91 06756

[51] Int. Cl.[5] ..... B24B 49/08; B24B 49/16

[52] U.S. Cl. ..... 51/165.9; 51/59 R

[58] Field of Search ..... 51/59 R, 59 SS, 165.77, 51/165.9, 165.76, 165.71

[56] References Cited

U.S. PATENT DOCUMENTS

| | | | |
|---|---|---|---|
| 1,933,373 | 10/1933 | Fraser | 51/165.9 |
| 2,606,410 | 8/1952 | Thery | 51/59 SS |
| 3,903,653 | 9/1975 | Imhoff et al. | 51/59 R |
| 4,558,537 | 12/1985 | MacLeod et al. | 51/165.92 |
| 5,060,423 | 10/1991 | Klotz | 51/165.76 |

*Primary Examiner*—Robert A. Rose

*Attorney, Agent, or Firm*—Sughrue, Mion, Zinn, Macpeak and Seas

[57] ABSTRACT

A polishing machine comprising a frame 1, a mobile polishing head 2 mounted on the frame, an abrasion tool 10, and a reciprocating slide 7 for causing the tool to polish a contacted object. The tool is mounted on a tool holder 9 fitted with a pneumatic system 36, 38; 50 producing a dual adjustment of the bearing pressure generated by the tool 10 on the object P being polished.

5 Claims, 4 Drawing Sheets

POLISHING MACHINE WITH PNEUMATIC TOOL PRESSURE ADJUSTMENT

BACKGROUND OF THE INVENTION

This invention concerns machines for polishing objects whose surfaces must exhibit a very high-quality luster.

One important condition required for obtaining high-quality polishing is the generation of a constant pressure of the abrasive on the object to be polished, so as to avoid deformations. One machine incorporating a vibrating tool has a balanced hydraulic suspension making it possible to keep the pressure constant when the height of the contact area varies while the abrasive tool travels over the object, as described in French Patent No. 73 14 262 and its Certificate of Addition No. 75 10 522.

If the treated object has a curvature or slope in the direction of vibration, the tool suspension system must react with a reduced time constant at most equal to the period of Vibration occurring transversely to the direction in which the tool advances, in order to satisfy the requirement dictating constant pressure between the tool and the object. Because of the low value of this period, the moving parts of the machine must have very low inertia, and the suspension must possess great flexibility.

SUMMARY OF THE INVENTION

A purpose of this invention is thus to provide a polishing machine, in particular of the vibrating type, which combines the aforementioned properties of low inertia and great flexibility. Such purpose is satisfied by a machine for polishing objects comprising a frame, a polishing head mounted so as to be mobile on the frame, a tool, and means for initiating movement of the tool in order to cause it to produce a polishing action on an object with which it is placed in contact, by moving the polishing head in relation to the frame. The machine is characterized by the tool being mounted on start-up means using a tool holder provided with a pneumatic system producing a dual adjustment of the force of the bearing pressure generated by the tool on the object.

DETAILED DESCRIPTION OF THE PREFERRED EMBODIMENT

Figure 1:
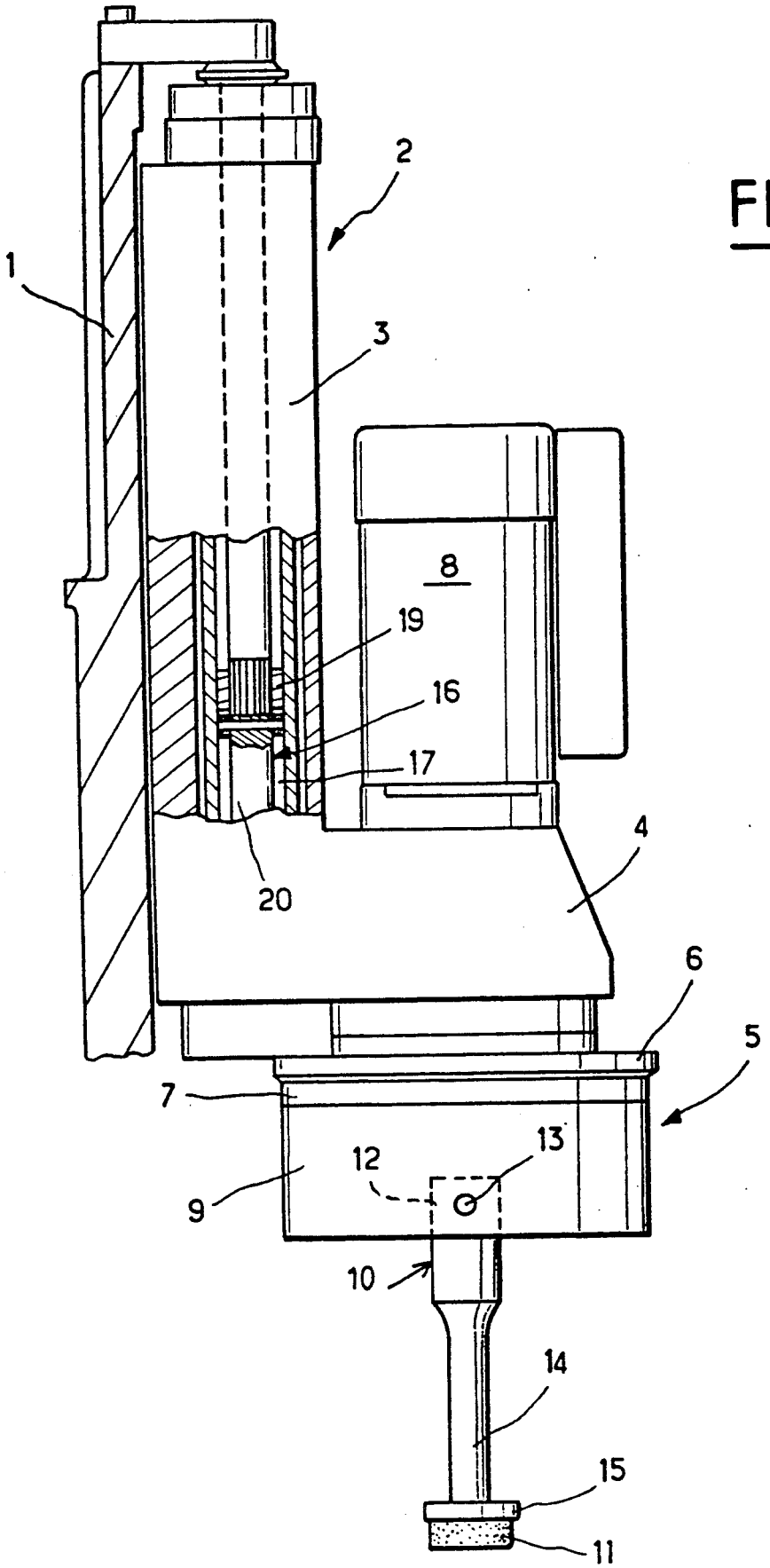
FIG. 1 is a schematic elevation of a polishing machine according to the invention.

The polishing machine in FIG. 1 basically comprises a vertical frame 1 on which a polishing head 2 comprising a square column 3 is vertically movable. A vibration or reciprocation assembly 5 comprising a support 6 for a slide 7 is attached to a horizontal arm 4 of the column 3.

An electric motor 8, which rotatably drives an internal connecting rod-crank assembly designed to impart an alternating translation or reciprocation motion to the slide, is positioned above the horizontal arm 4 of the column. A tool holder 9 mounting a tool 10 supporting, at its free end, a polishing stone 11 is fastened to the slide 7. The tool 10 comprises a tail piece 12 engaged and held in place in the tool holder 9 by a screw 13, extended by a shaft 14 fitted with a mounting 15 for the stone 11.

A mechanism producing vertical travel of the polishing head support in relation to the frame is embodied in conventional fashion in the column 3, and comprises a hydraulic jack 16 in which a cylinder 17, whose lower part is sealed with a plug, contains a piston 19 supported by a stationary shaft 20 attached to the frame 1. The jack is fed with a pressurized liquid through an inlet orifice located in its upper part, and is schematically illustrated in FIGS. 2 and 3, to which reference will now be made.

Figure 2:
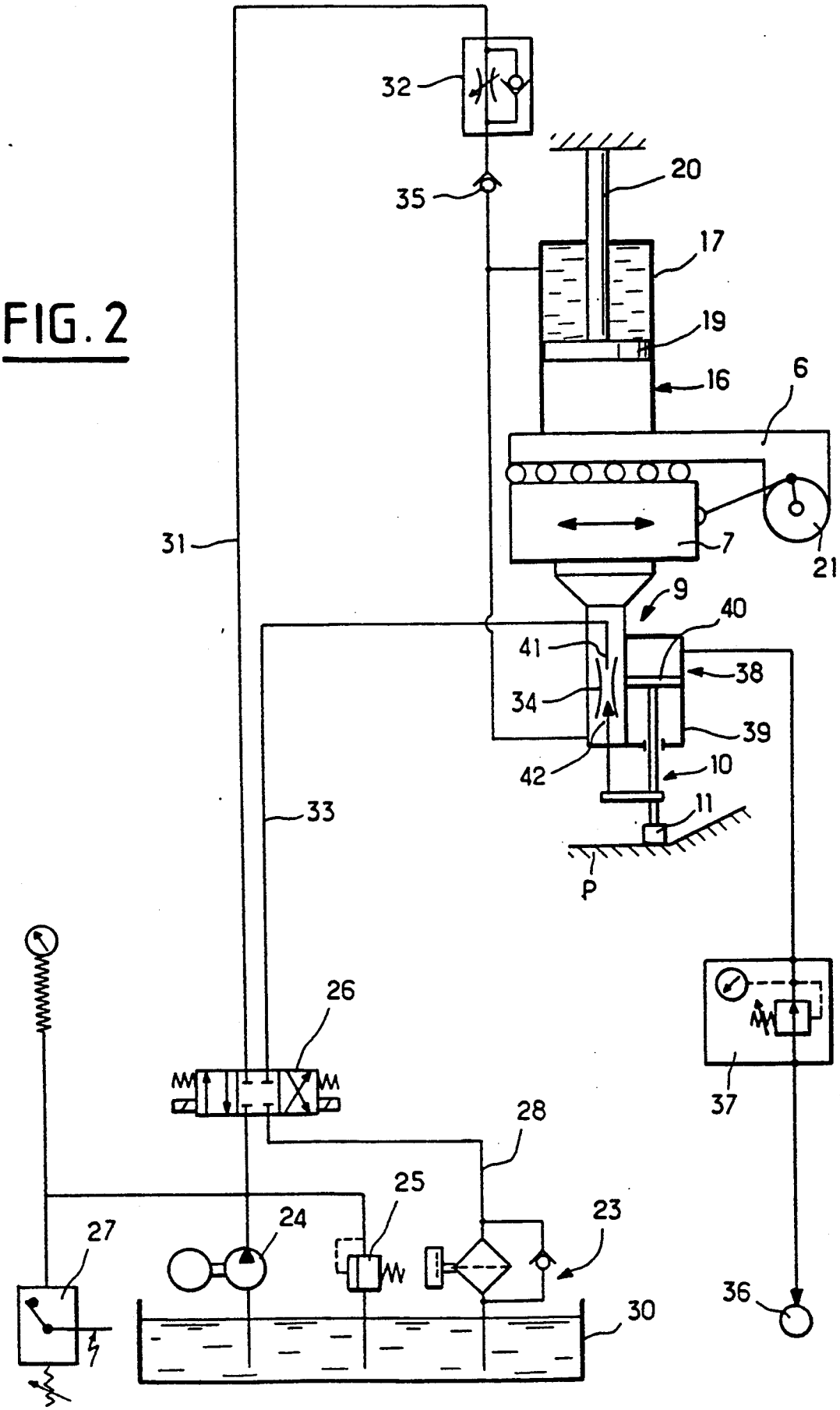
FIGS. 2 and 3 are diagrams of the hydraulic system for motion control of the polishing head in relation to the frame and of pneumatic means for the adjustment of the pressure exerted by the tool under different operating conditions of the machine.
Figure 3:
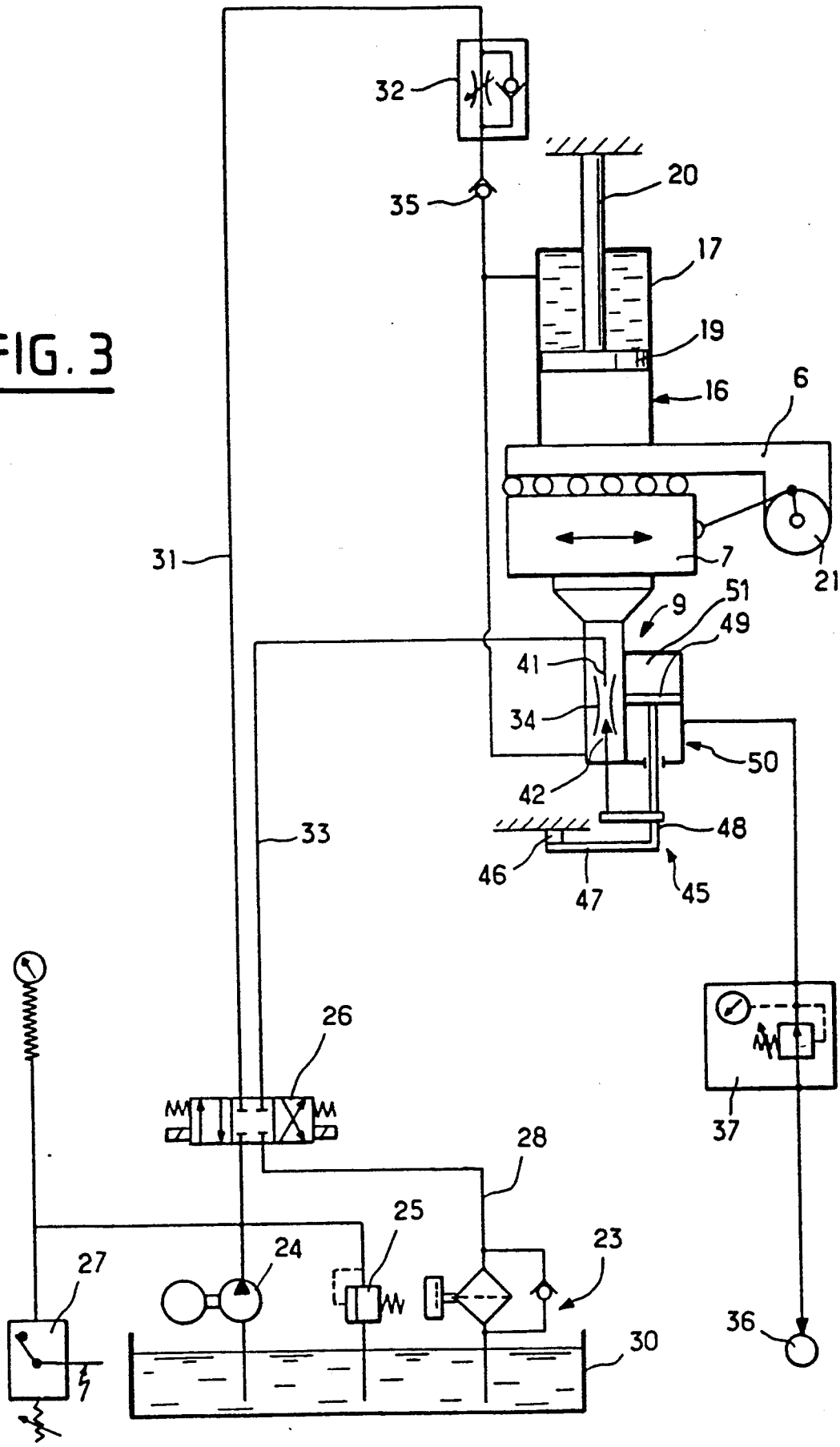

FIG. 2 represents the hydraulic and pneumatic systems controlling the various mobile devices in the machine which allow it to perform polishing operations using a downwardly directed tool. The stationary frame of the machine supports the shaft 20 of the piston 19. The cylinder 17 of the jack is fastened to the support 6 bearing the slide or carriage 7, which can be driven in an alternating motion in relation to the support 6 by a connecting rod-crank assembly 21 driven by the electric motor 8 (FIG. 1). The tool holder 9 is fastened to the slide 7.

Hydraulic fluid is fed to the jack 16 from a supply unit 23 comprising a pump 24 incorporating an overflow valve 25, a three position distributor 26, and a pressure regulator 27. The pump 24, the overflow valve 25, and a return pipe 28 are connected to a tank 30. A duct 31 connects the distributor 26 to a neck 32 which adjusts the flow of fluid feeding the cylinder 17 of the jack, and, accordingly, the rate of movement of the polishing assembly in relation to the frame. A duct 33 connects the distributor to a first inlet of a hydraulic regulator 34 contained in the tool holder 9, a second inlet of the regulator being connected to the adjustable neck 32 by a non-return valve 35.

The pneumatic system feeding the mechanism regulating the pressure of the tool on the object comprises a compressed air source 36, a pressure regulator 37, and a pneumatic jack 38 whose cylinder 39 is attached to the tool holder and whose piston 40 is fastened to the tool 10. The hydraulic regulator 34 comprises a narrowed space 41 which works in conjunction with a needle 42 which moves within the tool holder 9 with the jack piston 40.

In operation, to place the stone 11 in contact with the object P to be polished, the head 2 is first lowered in relation to the frame 1 of the machine. To this end, the distributor 26 is placed in a position such that fluid in the cylinder 17 of the jack 16 is drained to the tank 30 through the hydraulic regulator 34, and consequently the polishing unit attached to the cylinder moves downwardly. Simultaneously, the jack 38 is fed with compressed air so that its piston 40, which supports the tool 10, moves toward the bottom of the cylinder, thus causing the hydraulic regulator to open as a result of the movement of the needle 42 outside the narrowed opening 41. The flow rate of the hydraulic fluid then reaches its maximum, and the polishing head moves downwardly at maximum speed.

When the polishing stone 11 comes into contact with the object P, the piston 40 tends to rise again into the cylinder 39, which continues to descend under the action of the hydraulic mechanism, drawing with it the needle 42, which reduces the flow area or cross-section of the narrowed opening 41 in the regulator 34, until a position of equilibrium, i.e., the working position of the stone, is reached.

When the stone 11 contacts a surface exhibiting variations in height, for example when, during the polishing operation, it encounters a sloping surface, the piston 40 is pushed upwardly, and the excess pressure generated in the cylinder 39 by the upward motion of the piston 40 is bled off through an outlet aperture (not shown).

When the tool is to be lifted from the object being polished, the distributor 26 is shifted to a tool-disengagement position. The pump 24 then discharges into the cylinder 17 of the jack 16, thereby causing the cylinder 17 to rise in relation to the piston 19.

With the arrangement just described, the tool 10, which possesses a low level of inertia in comparison with the rest of the machine, can be moved very rapidly in order to follow a varying surface of the object being polished, since only pneumatic adjustment affects the low-amplitude variations of the tool.

FIG. 3 represents the same hydraulic and pneumatic systems comprising means allowing the machine to perform polishing operations using an upwardly directed tool. The components identical to those in FIG. 2 have the same reference numbers and will not be described again.

The arrangement shown in FIG. 3 differs from that in FIG. 2 by virtue of the fact that it comprises a tool 45 designed to polish a surface positioned above it. To this end, the tool 45 incorporates a bend, and supports a polishing stone 46 at the end of a horizontal arm 47. A vertical arm 48 of the tool forms one piece with the piston 49 of another jack 50, which is connected to the tool holder 9. The lower part of the cylinder 51 of the jack 50 is fed with compressed air, and the needle 42 of the hydraulic regulator is connected to the vertical arm 48 of the tool.

The operation of the arrangement in FIG. 3 is similar to that of the arrangement in FIG. 2, except that the stone 46 is brought into contact with the surface to be polished when the tool moves upwardly as a result of feeding the cylinder 50 from the bottom. With this configuration, the weight of the tool is always balanced, whether it is operated during descent or when rising.

Figure 4:
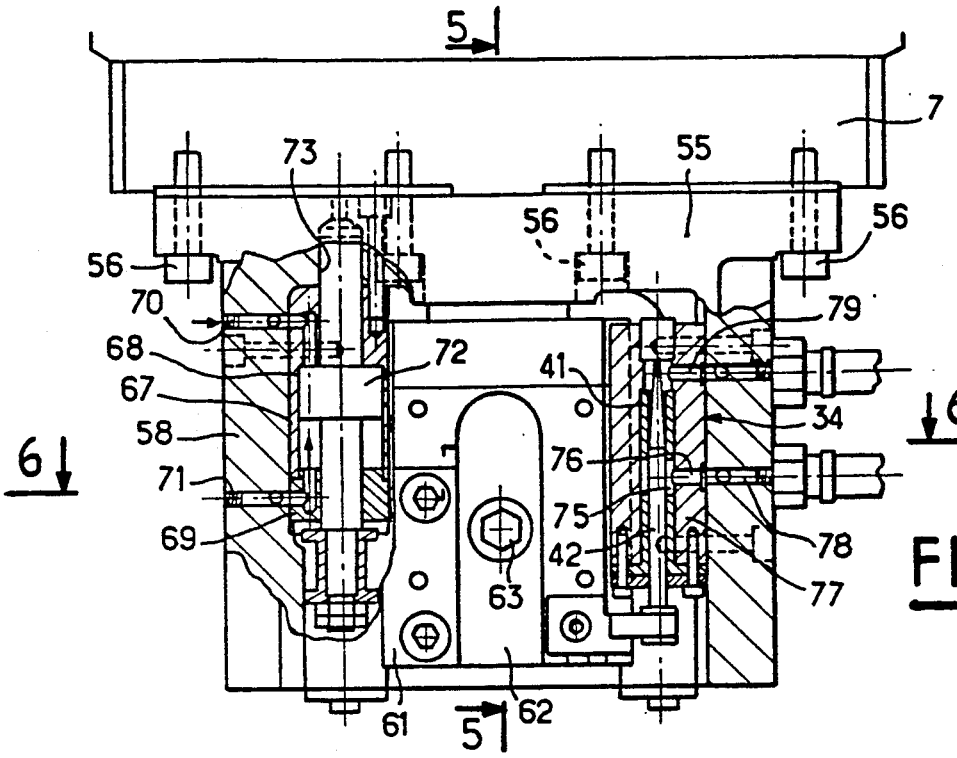
FIG. 4 is a detailed cross-section of a tool holder for implementing the invention.
Figure 6:
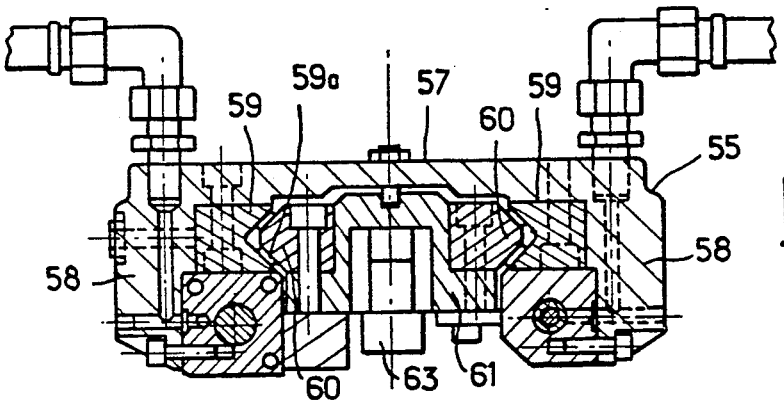
FIG. 6 is a cross-section taken along line 6—6 in FIG. 4.
Figure 5:
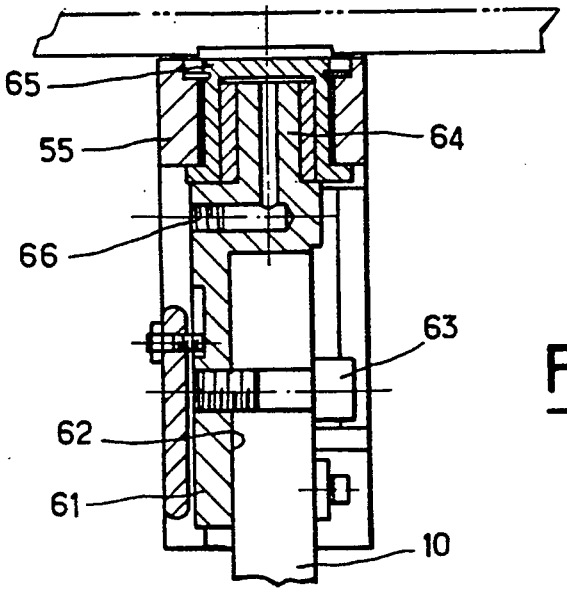
FIG. 5 is a cross-section taken along line 5—5 in FIG. 4.

A special embodiment of a tool holder for a polishing machine according to the invention will now be described with reference to FIGS. 4 to 6. The tool holder comprises a body 55 attached by screws 56 to the slide or carriage 7 of the reciprocation device. As shown clearly in FIG. 6, the body 55 of the tool holder comprises a vertical wall 57 and two parallel lateral arms 58, which delineate, in conjunction with the vertical wall 57, a duct in which guide rails 59 are attached. These rails mate, with the interposition of rows of bearing needles 59*a*, with supplementary guide rails 60 mounted to a carriage 61 in which the tail piece of a polishing tool is inserted. Accordingly, the carriage 61 defines a recess 62 fitted with a screw 63 which fastens the tail piece of the tool on the carriage. At its end opposite the recess 62, the carriage has a post forming a piston and engaged in a jacket 65 forming a cylinder defined in the body 55, thereby forming a first jack 64 which is fed with compressed air through a passage 66 in the carriage. A second jack 67, formed by a thick-bottomed bushing 68 sealed with a plug 69, is also mounted in the body 55. Compressed air-feed ducts 70, 71 are formed in the bushing and the plug, and pass through the lateral arm 58 of the body 55 in which the second jack is mounted. The bushing 68 houses a piston 72 positioned on the intermediate part of a shaft 73, one end of which extends below the plug and is joined to the carriage 61. The second jack 67, which may be fed with compressed air on either side of the piston 72, is thus a dual-action jack. When it is fed from the top, its action is added to that of the first jack 64, thus lowering the tool. Finally, the body 55 further houses the hydraulic regulator 34, whose needle 42 is fastened to the carriage 61 as shown in FIG. 4, and whose narrowed space 41 is formed by a sleeve drilled with transverse holes 75. These holes connect with the hydraulic supply source by means of a passage 76 in the body 77 of the regulator, and a passage 78 in the lateral arm 58 of the body 55 opposite the arm in which the second jack 67 is mounted. Another passage 79 connected with the hydraulic supply source is formed above the sleeve 41.

The tool holder described with reference to FIGS. 4 to 6 thus comprises a first single-action jack 64 positioned in the upper part of the carriage 61 and which corresponds to the jack 38 fed with compressed air, in order to operate the polishing machine during its downward motion. To this first jack may be associated the second dual-action jack 67 which is fed above its piston 72 through passage 70. The second jack further ensures the operation of the jack 50 in the simplified, schematic configuration shown in FIG. 3. It is designed to raise the polishing stone 46 when pressurized from the bottom through duct 71.

The tool holder described with reference to FIGS. 4 to 6 thus provides the function of pneumatic damping of the tool as the machine functions while descending and while rising. Moreover, because of the pressure of the needle regulator 34, the tool holder ensures hydraulic regulation of the movements of the polishing unit in relation to the object being polished.

In the embodiment shown in FIG. 1, the invention is applied to a polishing tool, which is subjected only to an alternating translational or reciprocating motion. It will be understood, however, that the invention is equally applicable to a tool subjected to both reciprocating and axial rotation movements.

The pneumatic system ensures the adjustment of the force exerted by the polishing tool on the object being polished by sensing, by means of the polishing stone, the position of contact between the stone and the surface of the object. This is accomplished by automatically monitoring the weight of the tool, whether the latter operates while descending or rising. Thus, the tool further constitutes a device which senses the position of the polishing head in relation to the object being polished.

We claim:

1. A polishing machine, comprising: an elongate frame (1), a polishing head assembly movably mounted on the frame, a polishing tool (10; 45) mounted on a tool holder (9) carried by the assembly, means for initiating the tool to execute a polishing action on a workpiece (P) width which it is placed in contact by moving the polishing head assembly parallel to the frame and generally perpendicularly to the workpiece, transverse reciprocating motion means (6, 7) interposed between and interconnecting the tool holder (9) and the head assembly for imparting a back-and-forth movement to the polishing tool in a direction generally parallel to a surface of the workpiece being polished, and a dual-action pneumatic system (38; 50) coupled to the tool holder for regulating the pressure exerted by the tool on the workpiece, wherein the tool holder comprises a body (55) attached to the transverse reciprocating motion means (6, 7), a carriage (61) fitted with means (62, 63) for mounting the tool and slidably mounted in the body (55), said carriage comprising at an end opposite the tool, a piston (64) engaged in a cylinder (65) mounted in the body, the piston and cylinder forming a first pneumatic jack for actuating the tool in a descending mode, the carriage being mechanically linked to a a needle (42) mounted so as to be movable in a sleeve (41) which forms a narrowed passage for hydraulic regulation means (34) controlling the initiating means (16, 17, 19, 20) for moving the polishing head assembly, said sleeve being disposed in a body (77) mounted in the body of the tool holder and being connected to a hydraulic system by passages (76, 78, 79), and wherein the tool holder is further provided with a second pneumatic jack (67) mounted in the body of the tool holder, said second jack having a piston (72) fixed to a shaft (73) mechanically linked to the carriage (61), the second jack being capable of being fed on either side of the piston (72) from a compressed air source through respective feed ducts (70, 71) in order to effect the descending or ascending movement of the tool.

2. A polishing machine according to claim 1, wherein a force produced by the second jack when fed on one side of the piston and tending to lower the tool is added to the force of the first jack.

3. A polishing machine, comprising:

a) a support column (3), b) a hydraulic jack (16) coupled between the support column and a fixed frame (1) for vertically moving the support column relative to the frame, c) a tool holder (9) disposed below the column, d) motor driven means (6, 7, 2) coupled between the tool holder and the column for imparting a horizontal reciprocating motion to the tool holder, e) pneumatic jack means (38; 50) comprising a cylinder fixed to the tool holder and a piston rod extending downwardly therefrom, f) hydraulic regulator means (34) fixed to the tool holder, g) hydraulic flow control means (42) fixed to the piston rod and cooperable with the regulator means, and h) a polishing tool (10; 45) fixed to the piston rod, i) wherein the engagement of a workpiece (P) by the polishing tool causes the flow control means to restrict a hydraulic flow through the regulator means to attendantly reduce a force applied to the tool by the hydraulic jack, thereby enabling the tool to apply a uniform polishing force to the workpiece and to follow surface height variations thereof.

4. A polishing machine according to claim 3, wherein the pneumatic jack means comprises a first, single acting jack (64, 65) for urging the tool against a workpiece disposed below the tool, and a second, double acting jack (67) coupled to the first jack for urging the tool against a workpiece disposed above the tool.

5. A polishing machine, comprising: an elongate frame (1), a polishing head assembly movably mounted on the frame, a polishing tool (10; 45) mounted on a tool holder (9) carried by the assembly, means for initiating the tool to execute a polishing action on a workpiece (P) width which it is placed in contact by moving the polishing head assembly parallel to the frame and generally perpendicularly to the workpiece, transverse reciprocating motion means (6, 7) interposed between and interconnecting the tool holder (9) and the head assembly for imparting a back-and-forth movement to the polishing tool in a direction generally parallel to a surface of the workpiece being polished, and a dual-action pneumatic system (38; 50) coupled to the tool holder for regulating the pressure exerted by the tool on the workpiece, wherein the pneumatic regulation system comprises pneumatic jack means (38; 50) fed with compressed air from a source (36), said jack means being attached to the tool holder and the tool being attached to a piston (40; 49) of the jack means and constituting a device for sensing the position of the polishing head assembly in relation to the workpiece, wherein the tool holder further comprises hydraulic regulation means (34) controlled by movements of the jack means and connected in a hydraulic system which feeds the initiating means (16, 17, 19, 20) for moving the polishing head assembly in relation to the frame, and wherein the pneumatic jack means comprises at least one first jack (38) for operating the machine in a descending mode with the tool positioned above the workpiece, and a second jack (50) for operating the machine in an ascending mode with the tool positioned below the workpiece, the first and second jacks being mechanically linked to and controlling the hydraulic regulation means (34).

* * * * *